US008210450B2

(12) United States Patent
Zeinstra et al.

(10) Patent No.: US 8,210,450 B2
(45) Date of Patent: Jul. 3, 2012

(54) FLUID DISPENSING NOZZLE TIP ASSEMBLY WITH AN ADJUSTABLE GUIDE

(75) Inventors: Brian Zeinstra, Holstein (CA); Paul Groves, Alliston (CA); Dave Tracey, Shanty Bay (CA)

(73) Assignee: Honda Motor Co., Ltd., Tokyo (JP)

( * ) Notice: Subject to any disclaimer, the term of this patent is extended or adjusted under 35 U.S.C. 154(b) by 385 days.

(21) Appl. No.: 12/560,985

(22) Filed: Sep. 16, 2009

(65) Prior Publication Data

US 2011/0049270 A1 Mar. 3, 2011

(30) Foreign Application Priority Data

Aug. 31, 2009 (CA) ..... 2680881

(51) Int. Cl.

| | |
|---|---|
| ***B05B 15/04*** | (2006.01) |
| ***B05B 15/00*** | (2006.01) |
| ***B05B 15/06*** | (2006.01) |
| ***B05B 17/00*** | (2006.01) |

(52) U.S. Cl. ..... 239/288.3; 239/1; 239/288; 239/532

(58) Field of Classification Search ..... 239/1, 103, 239/288, 288.3, 288.5, 525, 530, 532, 602, 239/754; 118/301

See application file for complete search history.

(56) References Cited

U.S. PATENT DOCUMENTS

| | | | | |
|---|---|---|---|---|
| 2,440,084 | A * | 4/1948 | Goda, Sr. | 239/103 |
| 3,727,841 | A | 4/1973 | Hengesbach | |
| 5,372,389 | A | 12/1994 | Tam et al. | |
| 5,735,627 | A | 4/1998 | Nagao et al. | |
| 5,803,313 | A | 9/1998 | Flatt et al. | |
| 6,012,651 | A | 1/2000 | Spitznagel | |
| 6,213,410 | B1 | 4/2001 | Spitznagel | |
| 6,976,644 | B2 | 12/2005 | Troudt | |
| 2005/0081899 | A1 * | 4/2005 | Shannon | 134/172 |
| 2008/0264981 | A1 | 10/2008 | Hjort | |

* cited by examiner

*Primary Examiner* — Darren W Gorman
(74) *Attorney, Agent, or Firm* — Rankin Hill & Clark LLP

(57) ABSTRACT

Disclosed herein is a fluid dispensing assembly for operable coupling to a fluid supply. The fluid dispensing assembly has an adjustable guide spaced apart from a second end region for guiding the correct placement of the second end region relative a target such that the fluid is dispensed for adequate coverage of the target. The adjustable guide is permitted to selectively and reversibly engage with a locating formation in predetermined position such that an Associate is able to assume an ergonomically-friendly body posture during use. As such, the adjustable guide aims to provide an Associate with a means to dispense fluid at a target at the correct distance and angle relative the target while maintaining their body posture in an ergonomically-friendly position. By utilizing the adjustable guide, the Associate is able to adjust the guide such that a right-hand dominant Associate may address the target in an ergonomically-friendly body position which would otherwise be an ergonomically-friendly body posture for a left-hand dominant Associate and vise versa.

13 Claims, 4 Drawing Sheets

FLUID DISPENSING NOZZLE TIP ASSEMBLY WITH AN ADJUSTABLE GUIDE

FIELD OF THE INVENTION

The present invention relates to the dispensing of fluids, such as sealers and the like.

BACKGROUND OF THE INVENTION

In order to properly apply a paint or sealer on an assembly line, such as in the automotive industry, an Associate is under pressure to complete the task within a short time period such that the product can move to the next step in the assembly process. Often, in trying to apply the paint or sealer in an efficient manner and to ensure proper coverage, the Associate finds himself in positions that are not ergonomically-friendly and this places undue strain on the Associate's person, resulting in potential injuries and lost production time.

SUMMARY OF THE GENERAL INVENTIVE CONCEPT

In an exemplary embodiment, there is provided a fluid dispensing assembly comprising a body with an inner fluid channel and an outer body surface defining a central axis. The fluid channel has a first end region for fluid communication with a fluid supply. The fluid channel has a second end region adapted for spraying the fluid. An adjustable guide extends outwardly from the body between the first and second end regions. A first locating formation is located on the body and is complementary with a portion of the adjustable guide. The locating formation is for maintaining the adjustable guide in at least a first predetermined fluid guiding position. A biasing portion is provided for biasing the adjustable guide in the first predetermined position.

In some exemplary embodiments, the locating formation including a flange. The flange includes at least a first recess portion operable for reversibly receiving a portion of the adjustable guide.

In some exemplary embodiments, the flange includes a second recess portion spaced apart from the first recess portion for reversibly receiving a portion the adjustable guide in a second predetermined position.

In some exemplary embodiments, the biasing portion is operable for biasing the adjustable guide in the second predetermined position.

In some exemplary embodiments, the adjustable guide includes a proximal end and a distal end.

Some exemplary embodiments further comprise a sleeve slidably mounted on the body for travel between the first end region and the locating portion. The sleeve has an inner surface which is complementary with the outer body surface.

In some exemplary embodiments, the adjustable guide is coupled to the sleeve near the proximal end.

In some exemplary embodiments, the distal end of the adjustable guide is spaced apart from the second end region to allow correct placement of the second end region relative a target for fluid dispensing.

In some exemplary embodiments, the biasing portion is a coil spring and the body portion includes a coupling portion for coupling the coil spring located near the first end region. The coil spring is concentrically located on the body portion intermediate the coupling portion and the adjustable guide.

In some exemplary embodiments, the first end region is adapted for reversibly engaging with the fluid supply and includes a screw-type threaded portion for reversibly engaging with a complementary region located on the fluid supply.

In another exemplary embodiment, a method is provided for promoting an ergonomically friendly body posture of an Associate when applying a pressurized fluid to a target. The method comprises providing a fluid dispensing assembly in communication with a fluid supply near a first end region. The fluid dispensing assembly includes a body with an inner fluid channel terminating at an orifice located near a second end region thereof for delivering the pressurized fluid and an adjustable guide having a distal end thereof spaced apart from the orifice and extending outwardly beyond the body. First and second locating formations are located on the body and each being complementary with a proximal portion of the adjustable guide. The first and second locating formations being provided for maintaining the adjustable guide in a first and a second predetermined fluid guiding positions respectively. A biasing portion for biasing the adjustable guide in the first or second predetermined positions is also provided. The method also includes:

- orienting the adjustable guide to the first fluid guiding position by engaging the adjustable guide with the first locating formation;
- directing the adjustable guide near a first target location to deliver a first portion of the pressurized fluid to a predetermined region located on the first target;
- dispensing the first portion of the pressurized fluid onto the first target;
- orienting the adjustable guide to the second fluid guiding position by engaging the adjustable guide with the second locating formation;
- directing the adjustable guide near a second target location to deliver a second portion of the pressurized fluid to a predetermined region located on the second target; and
- dispensing the second portion of the pressurized fluid onto the second target.

In another exemplary embodiment, there is provided a fluid dispensing assembly comprising a body with an inner fluid channel and an outer body surface defining a central axis, the fluid channel having a first end region for fluid communication with a fluid supply. The fluid channel has a second end region adapted for spraying the fluid. A sleeve is slidably mounted on the body for travel between the first end region and a flange located on the body near the second end region. The sleeve has an inner surface which is complementary with the outer body surface. An adjustable guide having a proximal end and a distal end extends outwardly from the sleeve. The distal end is oriented such that it is spaced apart from the second end region. At least two spaced apart recess portions are located on the flange complementary with a portion of the proximal end of the adjustable guide for reversibly receiving the portion of the proximal end. The flange is provided for maintaining the adjustable guide in at least a first predetermined fluid guiding position or a second predetermined fluid guiding position. Furthermore, a coil spring is concentrically located on the body between the sleeve and the first end region operable for biasing the adjustable guide in the first predetermined position or the second predetermined position.

BRIEF DESCRIPTION OF THE DRAWINGS

Several embodiments of the present invention will be provided, by way of examples only, with reference to the appended drawings, wherein.

DETAILED DESCRIPTION OF THE EXEMPLARY EMBODIMENTS

Figure 1:
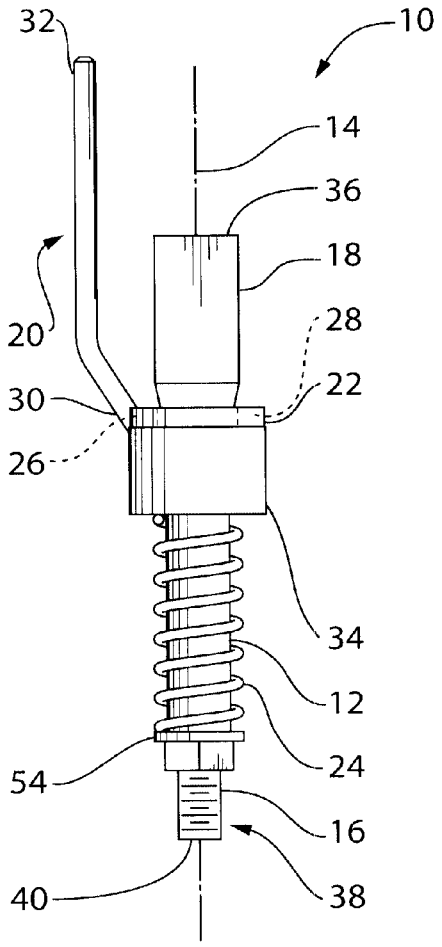
FIG. 1 is a side view of an embodiment of the fluid dispensing assembly of the present invention.

It should be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings. Furthermore, and as described in subsequent paragraphs, the specific mechanical, other configurations illustrated in the drawings are intended to exemplify embodiments of the invention. However, other alternative mechanical or other configurations are possible which are considered to be within the teachings of the instant disclosure.

Figure 2:
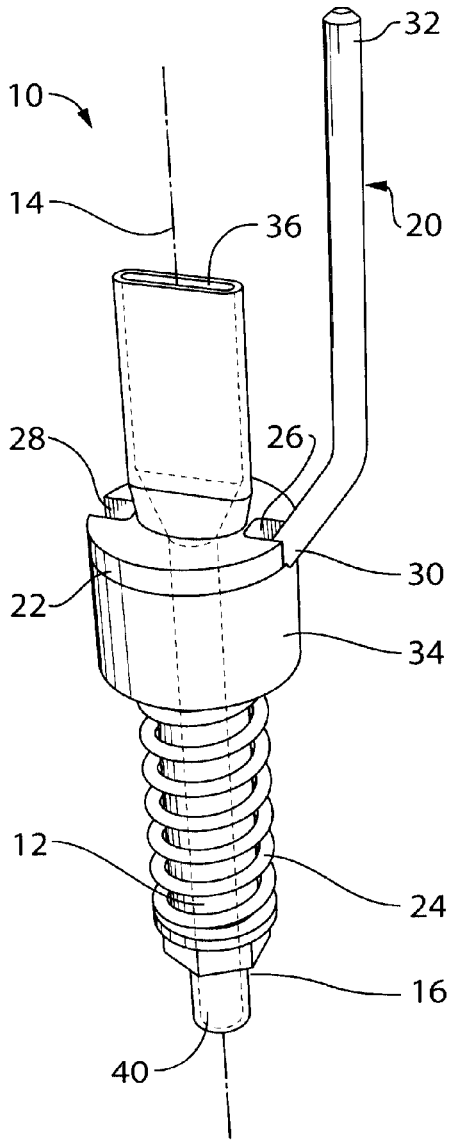
FIG. 2 is a three-dimensional view of an embodiment of the fluid dispensing assembly of the present invention showing the inner fluid channel in ghost, the orifice, and the first and second recess portions.
Figure 5:
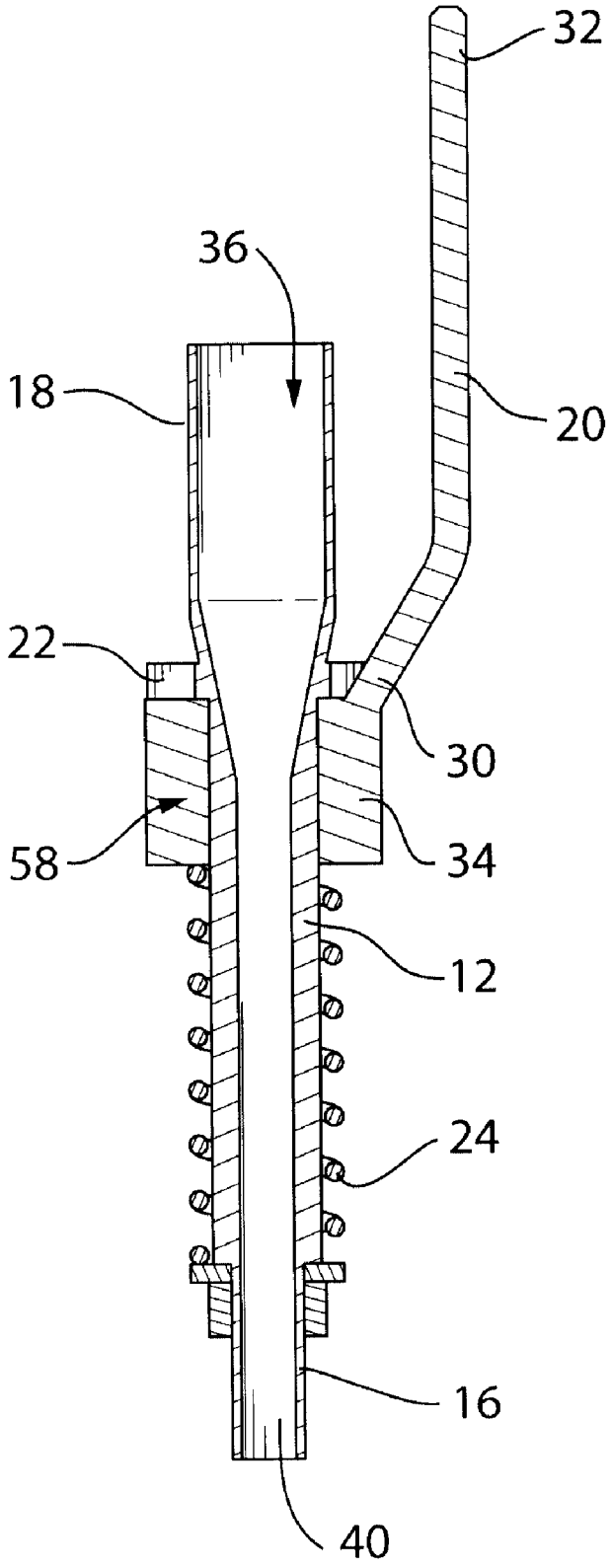
FIG. 5 is a cross-sectional view of an embodiment of the present invention showing the complementary arrangement of the outer surface of the body portion and the inner surface of the sleeve.

With reference to figures, the fluid dispensing device is generally shown at 10 and is provided with a body portion 12 defining a central axis 14. The body portion 12 is provided with a first end region 16 and a second end region 18 as is shown in FIGS. 1 and 2. An inner fluid channel 40 is shown, in ghost in FIG. 2 and in FIG. 5 which extends through the body portion 12 such that a fluid may travel therein, as it enters the first end region 16 towards the second end region 18 where the fluid is expelled from the fluid dispensing assembly 10. The second end region 18 is adapted for spraying a fluid (not shown). An orifice 36 is located at the terminus of the second end region 18 and is fashioned to provide a spray pattern for spraying the fluid in such a manner as may be desired.

In an alternative embodiment, an insert (not shown) may be provided to be located in the orifice 36 to provide the desired spray pattern of the fluid for a given application. Additionally, in another alternative embodiment, various differently shaped inserts to provide various different spray patterns may be provided. In this embodiment, the second end region 18 may be further provided with a mechanism to allow for interchangeability of the inserts. For example, the mechanism provided may be a screw-type mechanism or a snap-fit-type mechanism to allow for ease of interchangeability of the inserts.

Extending outwardly of the body portion 12 is an adjustable guide 20. The adjustable guide 20 aims to provide an Associate 42 (FIG. 3) with the correct orientation in which to place the second end region 18 such that, during use, the fluid being dispensed from the assembly 10 is targeted substantially correctly on a target 44. Furthermore, the adjustable guide 20 enables an Associate 42, as shown, to assume an ergonomically-favorable position when dispensing a fluid.

Figure 3:
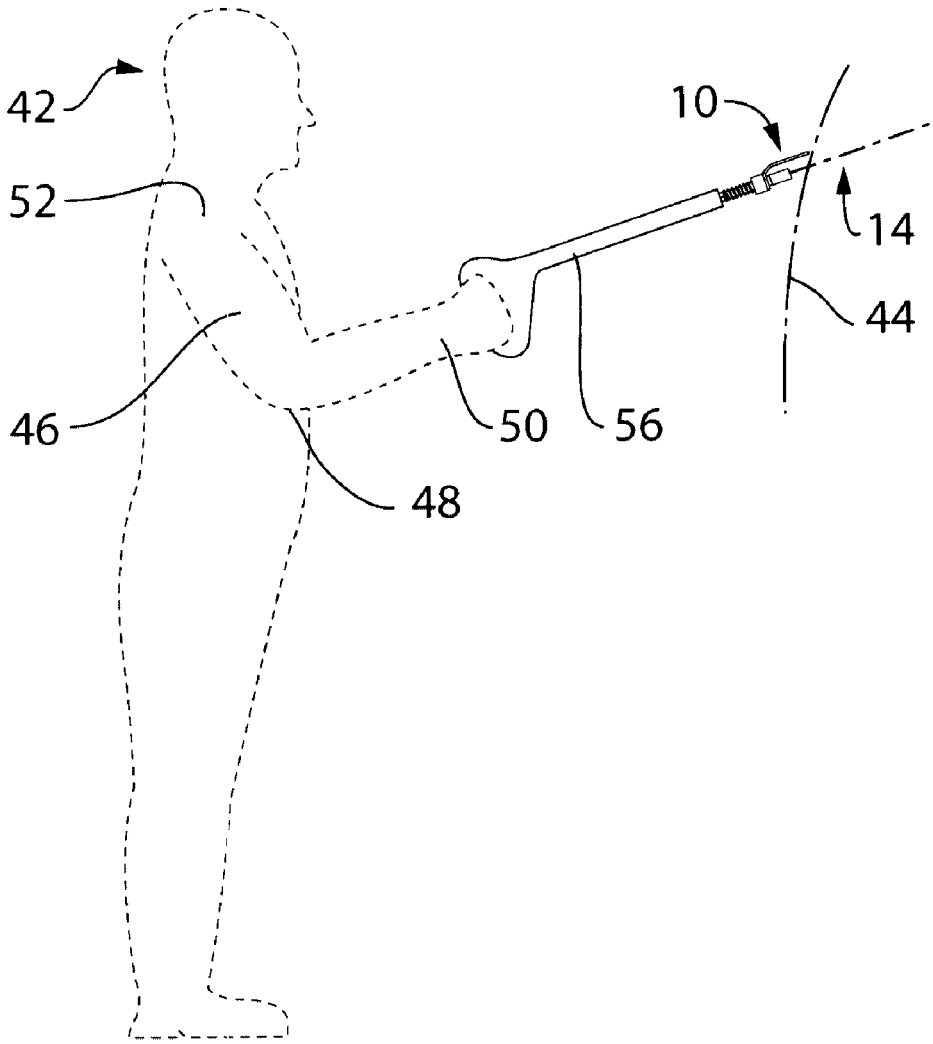
FIG. 3 is a side view of an embodiment of the present invention coupled to a fluid supply showing an Associate, in ghost, with the adjustable guide positioned in a preferred orientation relative a target in an ergonomically-friendly body posture.

For example, if the Associate 42 is right-hand dominant, as is shown in the figures, an ergonomically-friendly position for dispensing the fluid is when the Associate's 42 humerus 46 is in a downward position, substantially extending in front of the Associate 42. As shown in FIG. 3, in this orientation, in order to correctly place the adjustable guide 20 relative a target 44 surface for dispensing the fluid from the second end region 18, the distal end 32 of the adjustable guide 20 is placed in a position such that the distal end 32 is pointed in a substantially inclined orientation.

Figure 4:
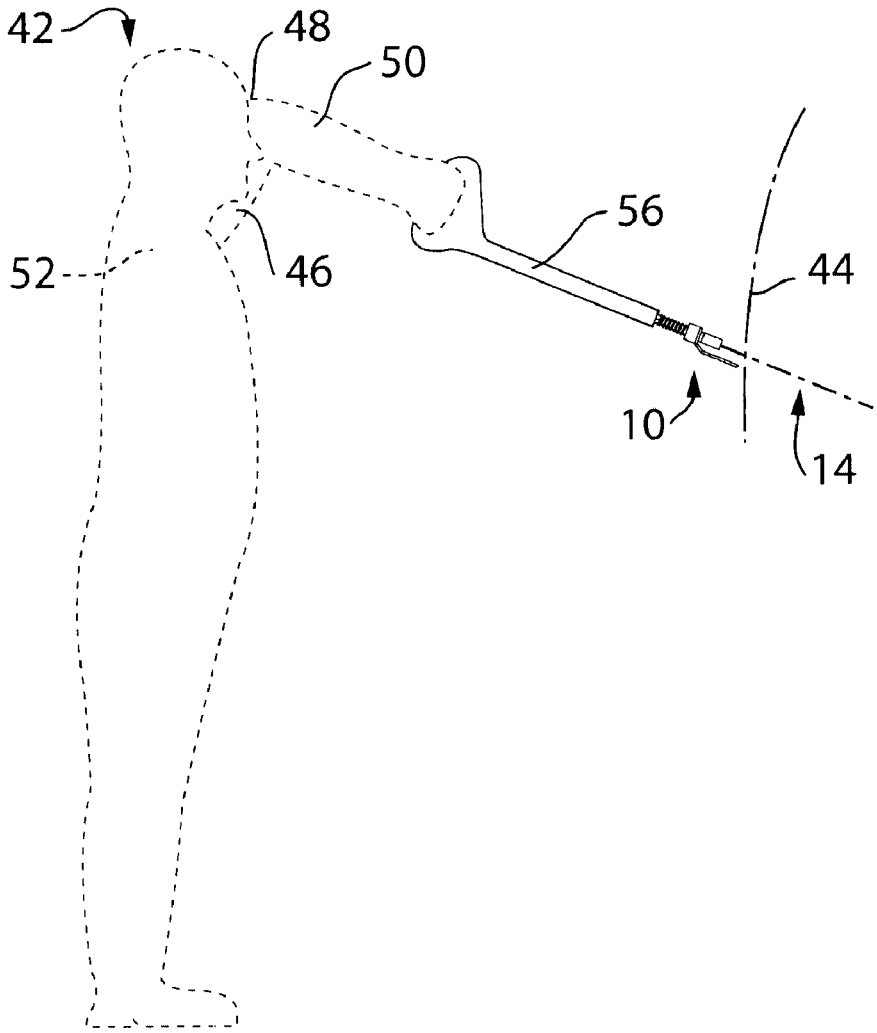
FIG. 4 is a side view of an embodiment of the present invention coupled to a fluid supply showing an Associate, in ghost, with a guide positioned relative a target in an ergonomically-unfriendly body posture.

In operation, with reference to FIG. 3, the fluid dispensing assembly 10 is oriented such that the adjustable guide 20 is above the plane of the central axis 14. The Associate's 42 arm is bent at the elbow 48 with his hand and forearm 50 substantially in front. However, in order to maintain this ergonomically-friendly body posture, the Associate 42 may not be able to adequately spray a desired fluid from the device on all required areas of a target 44. For example, in the case of the right-hand dominant Associate 42, as noted above, in order to adequately dispense the fluid onto certain areas of target 44 using the adjustable guide 20 for correct second end region 18 placement, the Associate 42 may be required the adjust his posture such that his humerus 46 is located substantially higher than the clavicle 52 as is shown in FIG. 4. This position is not ergonomically-friendly and places undue strain on the Associate 42 which can lead to fatigue and injury. In this case, the adjustable guide 20 may be relocated about the central axis 14, so that it is once again above the central axis 14.

Likewise, in the case of a left-hand dominant Associate 42, the adjustable guide 20 may similarly be oriented to enable the Associate 42 to assume an ergonomically-friendly position as shown in FIG. 3, however in reverse.

With reference to the figures, specifically FIGS. 1 and 2, the distal end 32 of the adjustable guide 20 extends beyond the second end region 18. Located near the second end region 18 there is a first locating formation 22 for maintaining the adjustable guide 20 in a predetermined position. For example, the first locating formation 22, herein also referred to as a flange 22, serves as a locating abutment for the complementary adjustable guide 20 under the biasing action of a biasing portion 24. In an exemplary embodiment, a sleeve 34 is slidably mounted on the body portion 12. The adjustable guide 20 is coupled at its proximal end 30 to the sleeve 34. The sleeve 34 is permitted, in this case, to travel along the body portion 12 between the flange 22 and a location 54 near the first end region 16. Furthermore, the sleeve 34 has an inner surface 58 (as is shown in the cross-sectional view of FIG. 5), which is complementary to the outer the surface of the body portion 12 between the flange 22 and the first end region 16.

As is shown in FIGS. 1 and 2, the biasing portion 24 is coupled to the body portion 12 near the first end region 16. The biasing portion 24 biases the adjustable guide 20 against the first locating formation 22 in a predetermined position. In an exemplary embodiment, the biasing portion 24 is a coil spring 24 located concentrically about the body portion 12 along the central axis 14. The coil spring 24 is biased against the sleeve 34 to maintain the adjustable guide 20 against the flange 22 in a predetermined position. Additionally, the coil spring 24 has a suitable spring force constant such that the Associate 42 may selectively overcome the spring force constant in order to slide the sleeve 34 along the body portion 12 towards the first end region 16 to relocate the adjustable guide 20 to a second predetermined position. When the Associate 42 releases the sleeve 34, the coil spring 24 again biases the sleeve 34 and the adjustable guide 20 against the flange 22 and maintains the adjustable guide 20 in a predetermined position.

The biasing portion 24, in certain embodiments, may be provided in other forms, including a tube or sleeve of made of an elastomeric material or the like, oriented in such a manner as to operably bias the adjustable guide 20 against the first locating formation 22.

With reference to FIG. 2, the flange 22 is shown with a first recess 26 and a second recess 28, defining a first predetermined position and second predetermined position respectively, for locating the adjustable guide 20 relative to the body portion 12. With reference to FIG. 2, a portion of the proximal end 30 of the adjustable guide 20 may be reversibly received into the first recess 26, thus defining a first predetermined position of the adjustable guide 20. In order to move the adjustable guide 20 to a second predetermined position, the Associate 42 draws the sleeve 34, against the bias of the coil spring 24 and towards the first end region 16, rotates the sleeve 34 about the body portion 12, and then engages the proximal end 30 of the adjustable guide 20 into the second recess 28 located on the flange. When the proximal end 30 of the adjustable guide 20 is reversibly received into the second recess 28, the Associate 42 releases the sleeve 34 and the biasing portion 24 maintains the adjustable guide 20 in the second predetermined position.

It should be noted, however, that although the operation of the fluid dispensing assembly 10 is described with two predetermined positions, any number of predetermined locations for the adjustable guide 20 may be provided. For example, it may be desirable in certain applications to have more than two predetermined locations for the adjustable guide 20. Furthermore, it may be desirable in certain applications to have the predetermined positions a various angles relative each other. In an exemplary embodiment, the recess portions 26 and 28 are diametrically opposed, though this may not be necessary in other applications Furthermore, the adjustable guide 20 may be maintained in an operable position by various other means, such as with a set screw or the like.

The first end region 16 is threaded to provide a threaded coupling region 38 for connection to a fluid supply 56 as shown by way of example in FIGS. 3 and 4. Of course, the coupling region 38 and the receiver portion on the fluid supply 56 may be reversed.

The coupling region 38 may be located at an alternative location on the body portion 12 other than the first end region 16, if desired. In the interest of promoting an ergonomically-friendly body posture, for example to spray a fluid in a confined area, it may be desirable to have the fluid from the fluid supply 56 enter into the inner fluid channel 40 via the coupling region 38 at point intermediate the flange 22 and the second end region 18.

Manually applying sprayed fluids (such as paints, sealers or the like in a paint department of an automotive manufacturing plant or other such environment wherein a fluid is applied by spraying) is often "unfriendly" in terms of ergonomics. This is especially true when the fluid must be sprayed at a relatively precise angle and orientation relative a target 44. For example, applying a sprayed fluid, such as a sealer material to panel joints, hemmed surfaces, and other areas of an automobile to combat corrosion, water leaks, wind noise and the like, as well as paint to cover the automobile surface often involves regions of the target 44 surface which are hard for an Associate 42 to reach. The actions of an Associate 42 trying to reach these regions results in poor ergonomic postures, fosters repetitive or sustained unsupported bending and twisting actions of the Associate's limbs and body trunk. Particularly in the automotive industry, this is true when spray-applying a sealer material or a paint to sheet metal hems of the hood, trunk and tailgate assemblies of automobiles. By providing, for example, an adjustable guide 20 on the fluid dispensing assembly 10, the assembly 10 enables the Associate 42 to address ergonomic posture concerns by adjusting the guide 20 such that the Associate 42 may dispense the spray sealer material or paint correctly relative a target 44 while maintaining an ergonomically-friendly body posture. Further, the Associate 42 may adjust the guide 20 and maintain good body posture while moving from right-hand dominant to left-hand dominant adjustable guide 20 orientations and visa-versa while in the process of spray applying a sealer material or paint to a target surface 44.

While the fluid dispensing assembly 10 has been described for what are presently considered the exemplary embodiments, the invention is not so limited. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

The invention claimed is:

1. A fluid dispensing assembly comprising:

a body portion with an inner fluid channel and an outer body surface defining a central axis, the inner fluid channel having a first end region for fluid communication with a fluid supply;

the inner fluid channel having a second end region terminating at an orifice adapted for spraying the fluid;

a sleeve slidably mounted on the body portion for travel between the first end region and a locating formation, the sleeve having an inner surface which is complementary with the outer body surface;

an adjustable guide extending outwardly from the body portion between the first and second end regions, the adjustable guide having a proximal end region and a distal end region;

the adjustable guide being coupled to the sleeve near the proximal end region thereof and the distal end region extending beyond the second end region;

the locating formation located on the body portion and complementary with a portion of the adjustable guide, the locating formation for maintaining the adjustable guide in at least a first predetermined fluid guiding position; and a biasing portion for biasing the adjustable guide in the first predetermined fluid guiding position.

2. An assembly as defined in claim 1, the locating formation including a flange.

3. An assembly as defined in claim 2, the flange including at least a first recess portion operable for reversibly receiving a portion of the adjustable guide in the first predetermined fluid guiding position.

4. An assembly as defined in claim 3, the flange including a second recess portion spaced apart from the at least first recess portion for reversibly receiving a portion of the adjustable guide in a second predetermined fluid guiding position.

5. An assembly as defined in claim 4, the biasing portion being operable for biasing the adjustable guide in the second predetermined fluid guiding position.

6. An assembly as defined in claim 1, the distal end of the adjustable guide being spaced apart from the second end region to allow correct placement of the second end region relative a target for fluid dispensing.

7. An assembly as defined in claim 1, the biasing portion being a coil spring.

8. An assembly as defined in claim 7, the body portion including a coupling portion for coupling the coil spring located near the first end region.

9. An assembly as defined in claim 8, the coil spring being concentrically located on the body portion intermediate the coupling portion and the adjustable guide.

10. An assembly as defined in claim 9, the first end region being adapted for reversibly engaging with the fluid supply.

11. An assembly as defined in claim 10, the first end region including a screw-type threaded portion for reversibly engaging with a complementary region located on the fluid supply.

12. A method for promoting an ergonomically friendly body posture when applying a pressurized fluid to a target comprising the steps of:

a) providing a fluid dispensing assembly in communication with a fluid supply near a first end region; the fluid dispensing assembly including a body with an inner fluid channel terminating at an orifice located near a second end region thereof for delivering the pressurized fluid; an adjustable guide having a distal end thereof extending outwardly beyond the orifice and spaced apart from the body; first and second locating formations being located on the body, each locating formation being complementary with a proximal portion of the adjustable guide, the first and second locating formations for maintaining the adjustable guide in a first or a second predetermined fluid guiding positions respectively; and a biasing portion for biasing the adjustable guide in either the first or the second predetermined fluid guiding positions;

b) orienting the adjustable guide to the first predetermined fluid guiding position by engaging the adjustable guide with the first locating formation;

c) directing the adjustable guide towards a first target location to deliver a first portion of the pressurized fluid to a predetermined region located to the first target location;

d) dispensing the first portion of the pressurized fluid on the first target location;

e) orienting the adjustable guide to the second predetermined fluid guiding position by engaging the adjustable guide with the second locating formation;

f) directing the adjustable guide towards a second target location to deliver a second portion of the pressurized fluid to a predetermined region located on the second target location; and g) dispensing the second portion of the pressurized fluid onto the second target location.

13. A fluid dispensing assembly comprising:

a body with an inner fluid channel and an outer body surface defining a central axis, the inner fluid channel having a first end region for fluid communication with a fluid supply;

the inner fluid channel having a second end region terminating at an orifice adapted for spraying the fluid;

a sleeve slidably mounted on the body for travel between the first end region and a flange located on the body near the second end region, the sleeve having an inner surface which is complementary with the outer body surface;

an adjustable guide extending outwardly from the sleeve;

the adjustable guide having a proximal end region and a distal end region, the distal end region being spaced apart from the second end region and extending beyond the second end region;

at least two spaced apart recess portions located on the flange complementary with a portion of the proximal end region of the adjustable guide for reversibly receiving the portion of the proximal end region, the flange for maintaining the adjustable guide in a first predetermined fluid guiding position or a second predetermined fluid guiding position; and a coil spring concentrically located on the body between the sleeve and the first end region operable for biasing the adjustable guide in the first predetermined fluid guiding position or the second predetermined fluid guiding position.

* * * * *